US009802803B2

(12) United States Patent
Clüsserath et al.

(10) Patent No.: US 9,802,803 B2
(45) Date of Patent: Oct. 31, 2017

(54) FILLER ELEMENT AND FILLING SYSTEM

(71) Applicant: KHS GmbH, Dortmund (DE)

(72) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 104 days.

(21) Appl. No.: 14/763,559

(22) PCT Filed: May 23, 2013

(86) PCT No.: PCT/EP2013/001523
§ 371 (c)(1),
(2) Date: Jul. 27, 2015

(87) PCT Pub. No.: WO2014/124654
PCT Pub. Date: Aug. 21, 2014

(65) Prior Publication Data

US 2016/0009533 A1 Jan. 14, 2016

(30) Foreign Application Priority Data

Feb. 13, 2013 (DE) ..... 10 2013 101 419

(51) Int. Cl.
*B67C 3/02* (2006.01)
*B67C 3/00* (2006.01)
*B67C 3/26* (2006.01)

(52) U.S. Cl.
CPC ..... *B67C 3/002* (2013.01); *B67C 3/262* (2013.01); *B67C 2003/2602* (2013.01)

(58) Field of Classification Search
CPC .. B67C 3/002; B67C 3/262; B67C 2003/2602
See application file for complete search history.

(56) References Cited

U.S. PATENT DOCUMENTS 9,010,381 B2 * 4/2015 Clusserath ..... B67C 3/06 141/146
2011/0197996 A1 * 8/2011 Clusserath ..... B67C 3/001 141/311 R (Continued)

FOREIGN PATENT DOCUMENTS

DE 30 40 880 5/1982
DE 196 03 604 9/1997

(Continued)

*Primary Examiner* — Timothy L Maust
*Assistant Examiner* — Andrew StClair
(74) *Attorney, Agent, or Firm* — Occhuiuti & Rohlicek LLP

(57) ABSTRACT

A filler element includes a valve arrangement that switches it between filling mode and CIP mode by controlling a connection between a chamber formed in a housing and a CIP channel formed from a valve body provided at a filling-height-controlling element. Axial movement of a filling-height-controlling element through an extension connected to the chamber controls mode-switching. In both modes, a continuous fluid connection exists between the extension's CIP connection and the CIP channel. Axial movement of the filling-height-controlling element also controls filling height in the container. In CIP mode, a CIP flow formed in the housing conducts liquid CIP medium out of the boiler, through the filling element, and out into a CIP channel.

20 Claims, 8 Drawing Sheets

(56) References Cited

U.S. PATENT DOCUMENTS

| | | | | |
|---|---|---|---|---|
| 2011/0277881 | A1* | 11/2011 | Gruber | B67C 3/22 141/266 |
| 2011/0290374 | A1* | 12/2011 | Clusserath | B67C 3/06 141/67 |
| 2012/0174529 | A1 | 7/2012 | Clusserath | |
| 2014/0360624 | A1* | 12/2014 | Clusserath | B67C 3/001 141/91 |
| 2015/0013833 | A1* | 1/2015 | Clusserath | B67C 3/06 141/5 |
| 2016/0052765 | A1* | 2/2016 | Clusserath | B67C 3/007 141/6 |

FOREIGN PATENT DOCUMENTS

| | | |
|---|---|---|
| DE | 10 2009 009339 | 8/2010 |
| DE | 10 2011 120 164 | 6/2013 |
| IT | RE20 080 109 | 5/2010 |
| JP | 2004315045 | 11/2004 |
| JP | 2006232310 | 9/2006 |

* cited by examiner

FILLER ELEMENT AND FILLING SYSTEM

RELATED APPLICATIONS

This application is the national stage of international application PCT/EP2013/001523, filed on May 23, 2013, which claims the benefit of the Feb. 13, 2013 priority date of German application DE 102013101419.4, the contents of which are herein incorporated by reference.

FIELD OF INVENTION

The invention relates to bottle-processing, and in particular, to the filling of bottles or similar containers with liquid content.

BACKGROUND

Filler elements for filling containers, and especially for filling bottles with liquid contents, for example with beverages, are known. It is also known to provide a filling-height-controlling element that extends into the container during filling and that controls the filling height of the filling contents in the container. An example of such an element is a rod-shaped probe with at least one electrical probe contact. Another example is a Trinox tube or a return-gas tube.

It is also known to control filling height by adjusting an axial displacement of the filling-height-controlling element. The filling-height-controlling element in this situation is guided through the filler element housing of the filler element and out of the housing at a housing-passage area.

In order to avoid having dirt or germs penetrate via the housing-passage area, it is known to have a protection space in the filler element adjacent to the housing-passage area to accommodate a part of the length of the filling-height-controlling element. During the filling operation, this protection space is subjected to the pressure of an inert gas and separated, by a seal, from a volume that is being protected. The seal is located at a lower end of a tube section that forms the protection area. The tube projects above the dispensing opening of the filler element.

During the filling operation, the filling-height-controlling element is conducted through the seal in a sealed manner. For CIP cleaning, the filling-height-controlling element moves upwards and out of the seal. This forms a fluid connection for a fluid CIP medium into or out of the protection space.

One disadvantage of the above arrangement is that the seal arrangement at the lower end of the tube section that forms the protection space projects into a container during filling.

One solution is an extension that connects to a chamber in the filler element housing. The extension's axial length corresponds at least to the displacement travel range to be formed as a protection area for the filling-height-controlling element. A seal is then provided at this element. During axial adjustment of the filling-height-controlling element, the seal is moved in the extension within an adjustment travel range. The seal, being in the form of a piston, separates the protection area, which is formed inside the extension and above the seal, from the chamber that is produced with a cross-section enlarged in relation to the extension, and that, during the filling is a part of the gas channel for conducting process gases.

For CIP cleaning or for a CIP mode of the filler element, i.e. for creating a CIP flow channel, which includes the chamber and its extension, the seal is moved into the chamber in an opening travel, in order to open the fluid connection between the chamber and the extension. A disadvantage of these filler elements, however, is that the respective CIP flow path through the filler element can only be established after the opening of a further control valve provided at the filler element.

SUMMARY

An object of the invention is to provide a filler element that switches over between filling mode and CIP mode more easily with a simpler design and reduced complexity of control.

In one aspect, the invention features a valve body provided at a filling-height-controlling element. This valve body forms the only valve or switching element with which the filler element is switched between filling and CIP mode. The valve body carries out the switching only by axial movement of the filling-height-controlling element. Axial movement in one direction transitions the filling element into CIP mode, whereas axial travel in the opposite direction transitions the filling element into the filling mode. Examples of a suitable valve include a sealing element or a ring seal.

Additional valves actuated pneumatically and/or electrically or by other means, which would require switching in order to change between the two modes, are not required. This also makes it possible for the filler element to form switching valves entirely without such channels or flow paths inside the filler element housing.

In one aspect, the invention features an apparatus for filling containers with liquid filling contents. Such an apparatus includes a filler element that switches between a filling mode and a CIP mode. The filler element comprises a filler element housing, a liquid channel, a dispensing opening, a liquid valve, a chamber, an extension, a filling-height-controlling element, a valve body, a CIP channel, a CIP connection, a valve arrangement, and a flush closure element.

The liquid channel, which is configured to be connectable to a filling-contents boiler, is formed in the filler element housing.

The liquid valve is disposed in the liquid channel, which also forms the dispensing opening.

The filling-height-controlling element controls the filling height in the container. During filling, a first end of the filling-height-controlling element projects beyond the dispensing opening and extends into the container. Axial movement of the filling-height-controlling element within an adjustable range adjusts the filling height.

In CIP mode, the flush closure element closes the filler element at the dispensing opening and forms a CIP flow path forms in the housing for liquid CIP medium that is conducted out of the boiler, flows through the filling element, out of the filling element, and into the CIP channel.

The chamber is formed in the filler element housing. The extension, through which the filling-height-controlling element is guided, connects to the chamber on an upper side of the filler element housing facing away from the dispensing opening. The filling-height-controlling element connects to the CIP channel via the CIP connection. In CIP mode, the CIP flow path comprises the liquid channel, the chamber, and the extension.

The valve arrangement switches the filler element between the filling mode and the CIP mode by selectively blocking and clearing a fluid connection between the chamber and the CIP channel. The valve body is provided at the filling-height-controlling element. During the filling mode, the valve body blocks the fluid connection between the chamber and the CIP connection of the extension, and during CIP mode, it opens that fluid connection. Axial movement of the filling-height-controlling element controls the opening and closing of the valve body. The valve arrangement for switching the filler element between the filling mode and the CIP mode is formed from the valve body.

In some embodiments, the valve arrangement is formed exclusively from the valve body.

In other embodiments, the extension comprises a cylinder, and the valve body defines a piston that moves within the cylinder in response to axial movement of the filling-height-controlling element. This piston selectively blocks the fluid connection between the chamber and the CIP connection. Among these embodiments are those in which the valve body is configured to open the fluid connection between the chamber and the CIP connection by moving out of the extension and into a volume that has a cross-section that is larger than the valve body. Also among these embodiments are those in which the chamber has a cross-section that is larger than the valve body, and wherein the valve body is configured to open the fluid connection between the chamber and the CIP connection by moving out of the extension and into the chamber.

Other embodiments include a valve tappet for the liquid valve. In these embodiments, the valve tappet comprises a pipe that is coaxial with a filler element axis. The filling-height-controlling element is guided through the pipe. The CIP channel comprises a ring channel between the filling-level-controlling element and the valve tappet. This ring channel is open on an underside of the filler element, and opens into the chamber.

In some embodiments, the CIP connection of the extension is formed from a connecting channel in the filler element housing. In these embodiments, the connecting channel is connected to the CIP channel.

In yet other embodiments, the flush closure is configured to selectively cause the CIP flow path to run out of the filling-contents boiler, via the liquid channel, via the opened liquid valve, via an interior of the flush closure element, via the ring channel, via the chamber, via a valve formed from the valve body, and via the extension, which is connected to the channel.

Among the embodiments are those in which the filling-height-controlling element comprises a return gas tube, and those in which it comprises a Trinox tube.

Also among the embodiments are those in which the filler element is configured for filling containers at under-pressure, and those in which it is configured for filling containers at ambient pressure.

In some embodiments, the filler element is a multiple-filler element comprising a plurality of individual filler elements. Among these are embodiments in which the filling-height-controlling element comprises a plurality of return gas tubes, and a common adjustment device adjusts filling heights of the individual filler elements of the multiple filler element.

In some embodiments, the filling-height-controlling element comprises a plurality of return gas tubes connected to a filling-contents boiler by a common control valve.

In yet other embodiments, the filling-height-controlling element comprises a plurality of return gas tubes connected to a filling-contents boiler by a non-return valve arrangement. Among these are embodiments in which the non-return valve arrangement comprises at least one non-return valve for each return gas tube, those in which it opens into the chamber and either blocks or constricts a flow in out of the gas chamber, and those in which at least one non-return valve of the non-return valve arrangement first opens at a pressure that exceeds a filling pressure.

Other embodiments of the apparatus include a rotor. In these embodiments, the filler element is just one of a plurality of identical filler elements disposed on a periphery of the rotor.

As used herein, expressions such as "essentially" and "approximately" are intended to mean deviations that are insignificant to the relevant function. In some cases this includes deviations of less than 10%, however, in other cases, deviations in excess of 5% are significant.

As used herein, "upstream" and "downstream" are based on the flow direction, with "downstream" being in the direction of an average flow vector and "upstream" being a direction that is the opposite of the downstream direction.

Further embodiments, advantages, and application possibilities of the invention are derived from the following description of exemplary embodiments and from the Figures. In this situation, all the features described and/or pictorially represented are, individually or in any desired combination, basically the object of the invention, regardless of their inclusion in the claims or referral to them. The contents of the claims are also deemed constituent parts of the description.

BRIEF DESCRIPTION OF THE DRAWINGS

These and other features and advantages will be apparent from the following detailed description and the accompanying figures, in which.

DETAILED DESCRIPTION

Figure 1:
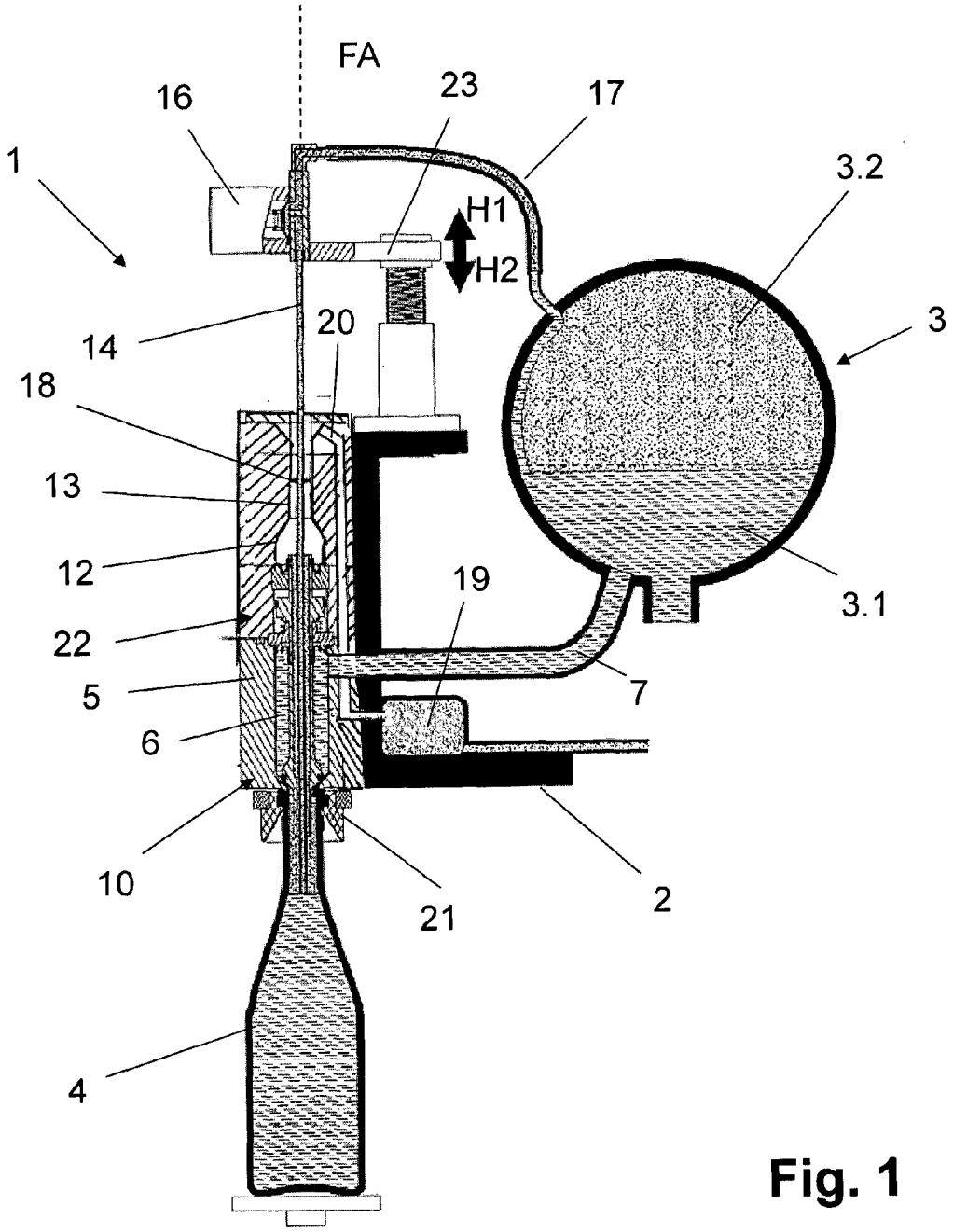
FIG. 1 shows a sectional view a filler element in the filling mode, together with a bottle that is to be filled.

FIG. 1 shows a filler element 1 that is one of a plurality of similar filler elements disposed around a circumference of a rotor 2 that rotates about a vertical machine axis. This rotor 2, its filler elements 1, and a boiler 3 provided at the rotor and common to all the filler elements 1 collectively form a filling system of a rotating filling machine for filling bottles 4 with liquid filling contents.

Figure 3:
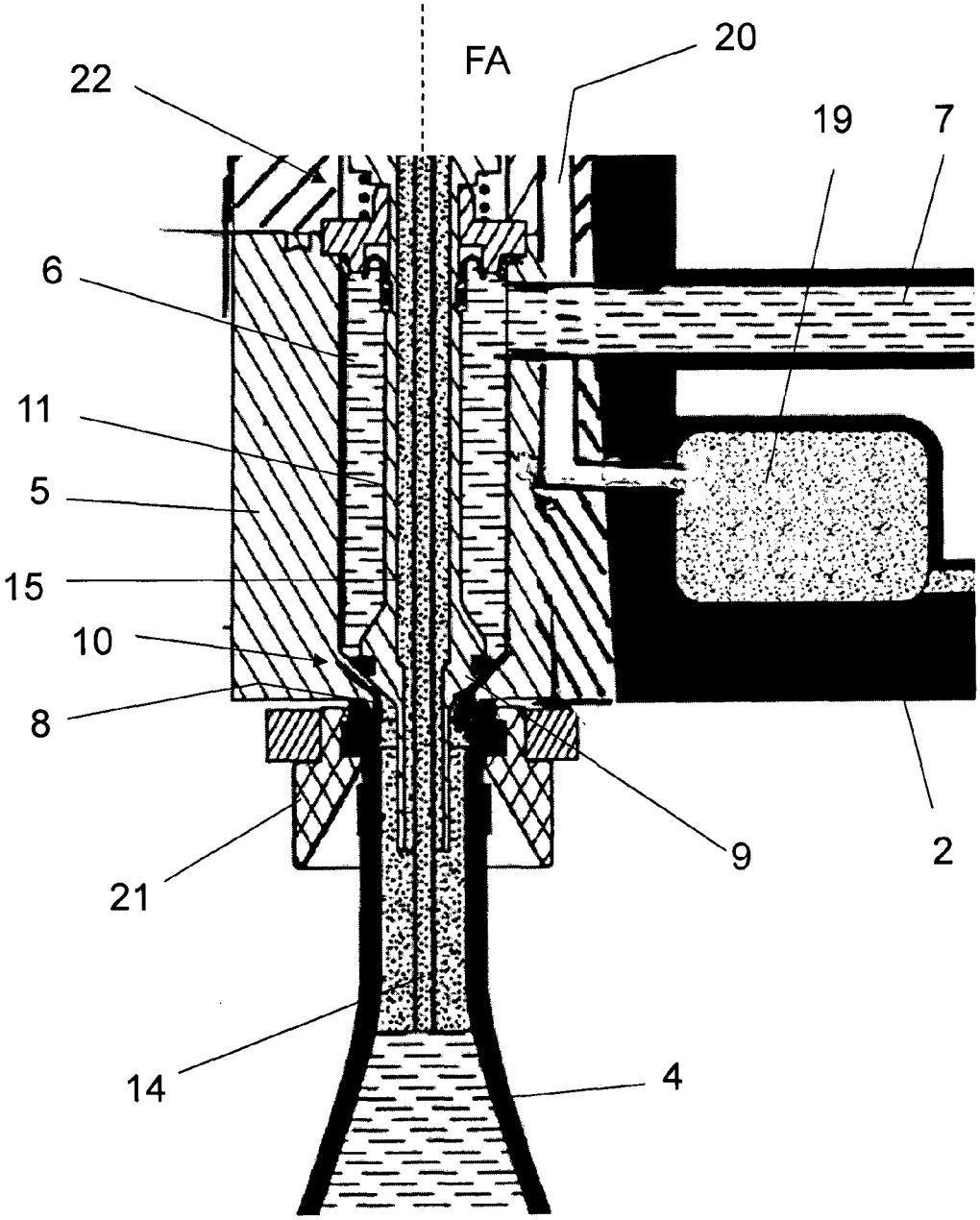

Within a housing 5 thereof, the filler element 1 comprises a liquid channel 6. A product line 7 connects on upper region of the liquid channel 6 to an interior of the boiler 3 in the region of a boiler base thereof. Referring now to FIG. 3, the liquid channel 6 forms a ring-shaped dispensing opening 8 on the underside of the housing 5.

During filling, the boiler 3 is partially filled with the liquid filling contents, thus forming a boiler liquid-space 3.1 and a boiler gas-space 3.2 therein. Liquid filling content from the boiler liquid-space 3.1 flows through the dispensing opening 8 and into a bottle 4 that is located in a sealed position at the filler element 1.

Upstream of the dispensing opening 8, and in the liquid channel 6 is a valve body 9 that forms a liquid valve 10. The valve body 9 is formed at a valve tube 11 that is coaxial with a vertical filler element axis FA.

The valve tube 11 serves as an actuating plunger for opening and closing the liquid valve 10. An open lower-end of the valve tube 11 projects downwards from above the dispensing opening 8 and extends into the bottle 4 during the filling. An open upper-end of the valve tube 11 opens into a gas chamber 12 formed in the housing 5.

Figure 7:
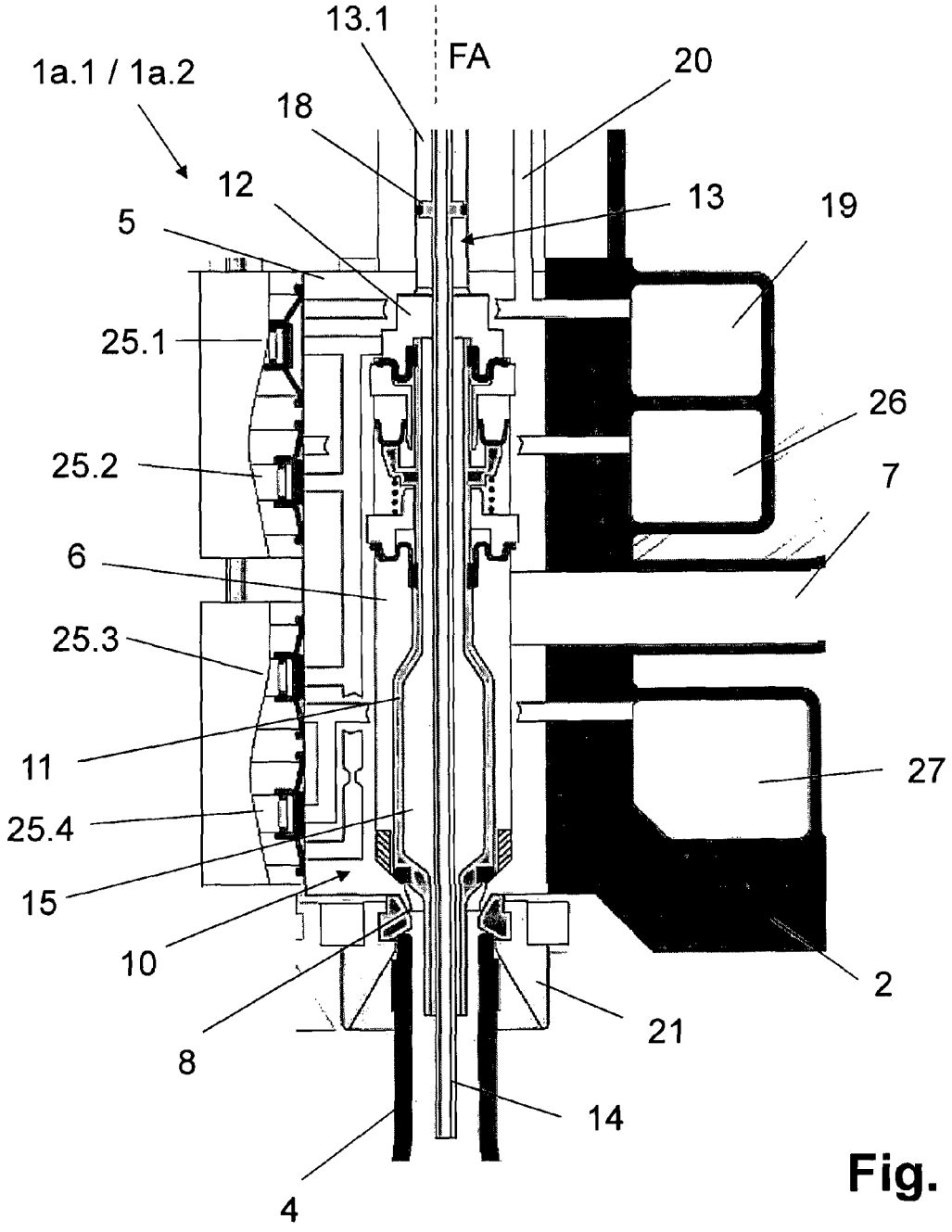
FIG. 7 shows a sectional view of a part of an individual filler elements from FIG. 6.

An extension 13 connects to the chamber 12 on an upper side thereof facing away from the valve tube 11. The extension 13 is a circular cylinder and coaxial with the filler element axis FA. In the filling mode, the extension 13 forms a protection area 13.1, as shown in FIG. 7.

To control filling height, the filler element 1 comprises a return tube 14. Examples of a return tube 14 include a return gas tube and a Trinox tube.

The return tube 14 is coaxial with the filler-element axis FA and surrounded by the valve tube 11. A gap between the valve tube 11 and the return tube 14 forms a ring channel 15 between an outer surface of the return tube 14 and the inner surface of the valve tube 11. An upper end of this ring channel 15 opens into the chamber 12. A lower end of this ring channel 15 opens at the lower end of the valve tube 11.

During the filling operation and in the filling mode respectively, the return tube 14 projects with its lower end beyond the lower end of the valve tube 11. As a result, the return tube 14 extends through the bottle aperture into the interior of the bottle that is to be filled. The return tube 14, which extends through the protection area 13.1, is conducted in sealed fashion towards the upper end of the filler element 1 and out of the housing 5. Outside the housing 5, the return tube 14 connects to the boiler gas-space 3.2 by way of a control valve 16 and a flexible line 17.

Figure 2:
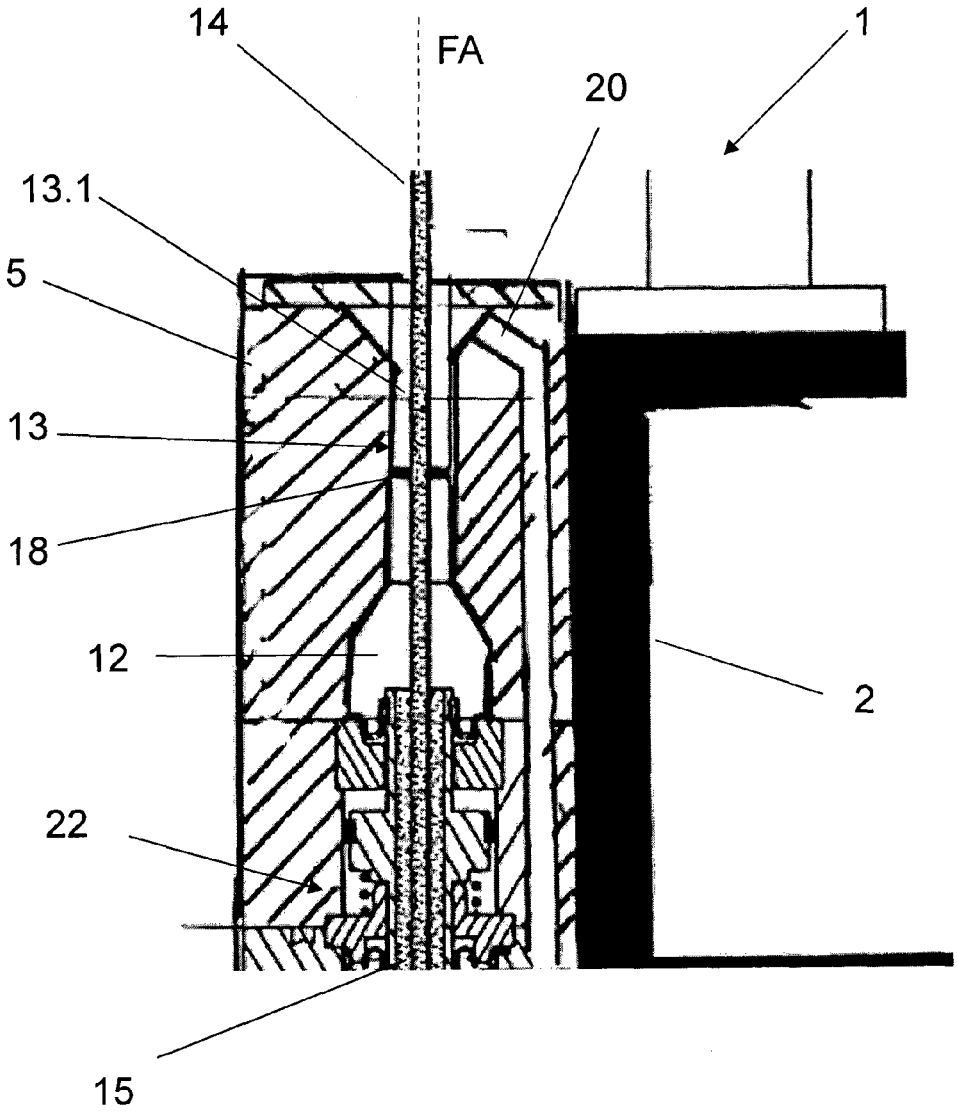
FIGS. 2 and 3 show details from FIG. 1.

A seal 18 is secured on the return tube 14 is a seal 18. During filling, the seal 18 seals against the circular cylindrical inner surface of the extension 13, thus forming a piston. As a result, the seal 18 separates the chamber 12 from the protection area 13.1 formed above the seal 18 in the extension 13, as shown in FIG. 2.

Figure 4:
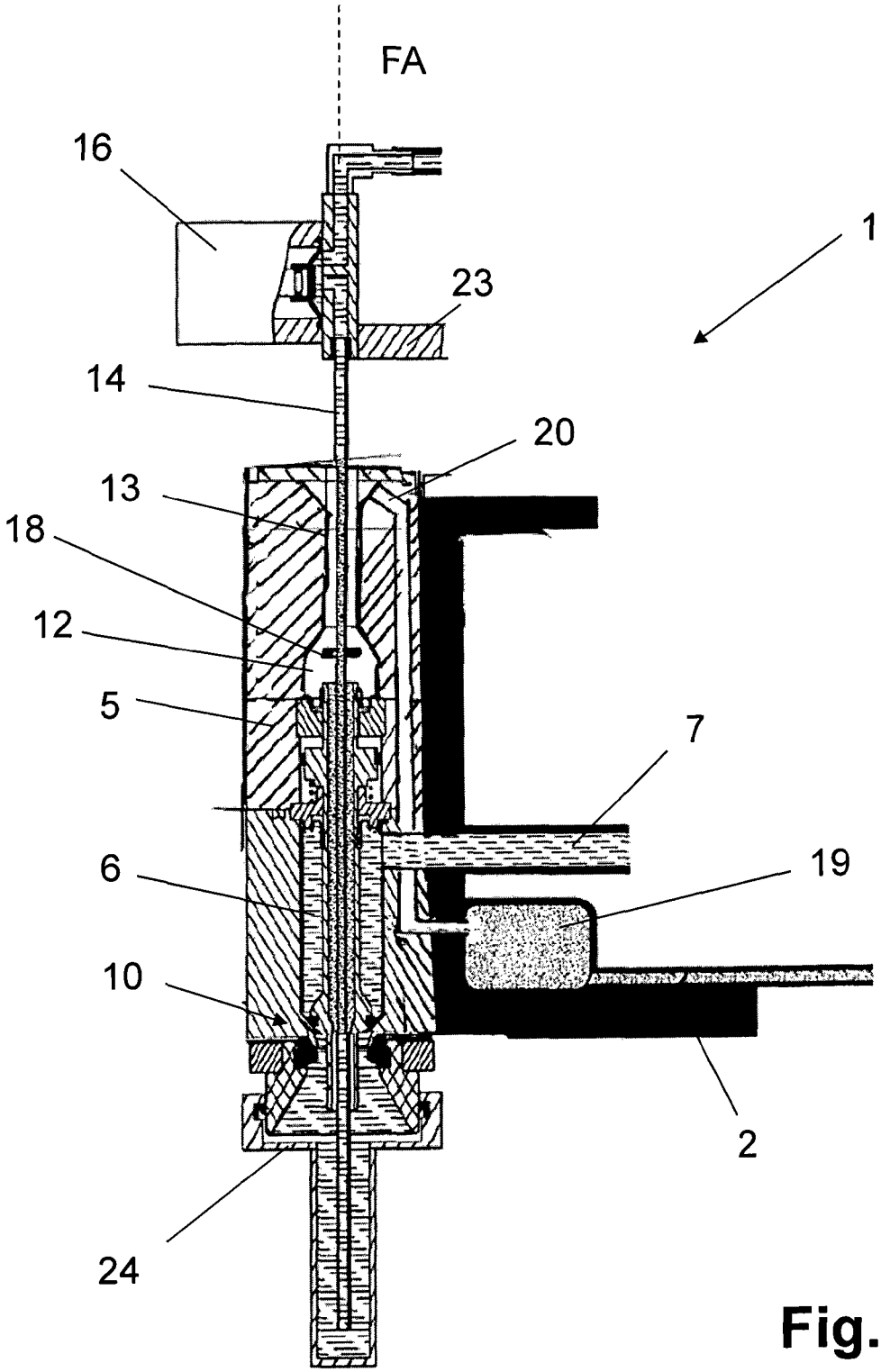
FIG. 4 shows a sectional view of the filler element from FIG. 1 in CIP mode.
Figure 5:
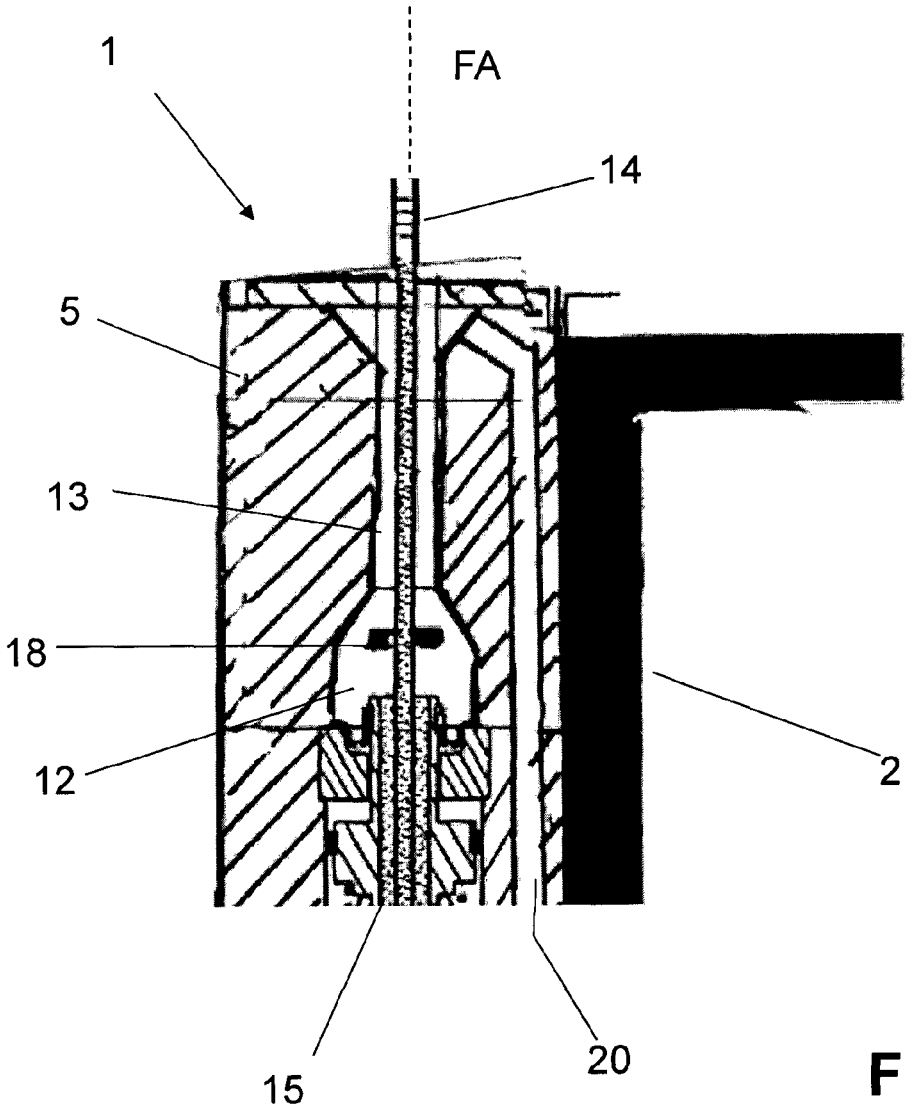
FIG. 5 shows details from FIG. 4.

A ring channel 19 common to all filler elements 1 of the filling machine is provided at the rotor 2. As shown in FIGS. 3 and 4, a connecting channel 20 formed in the housing 5 permanently connects the ring channel 19 to an upper end of the extension 13. During the CIP cleaning and/or CIP disinfection of the filler elements 1 or of the filling machine respectively, or of the filling system, i.e. in the CIP mode, the ring channel 19 conducts the CIP medium, and therefore serves as a CIP channel.

In the illustrated embodiment, the ring channel 19 is located on a horizontal level that is perceptibly below the level of the boiler 3, and in particular, of the base of this boiler 3. The upper end of the extension 13 and of the protection area 13.1 respectively are located approximately at the level of the base of the boiler 3, but in any event on a horizontal level below the level of the filling contents in the boiler 3 and below the level of the upper side of the boiler 3.

During filling, a bottle 4, which is arranged with its bottle axis along the filler-element axis FA, is pressed with its bottle opening in a sealed position against the filler element 1 or, respectively, against a seal of a centering element 21 surrounding the dispensing opening 8. In order to adjust the filling height, the return tube 14 is axially adjustable in an adjustment direction H1, as shown in FIG. 1.

The axial length of the cylindrical extension 13 is selected such that the seal 18 moves inside the extension 13 over the entire adjustment distance of the adjustment travel, thus retaining the separation between the chamber 12 and the protection area 13.1. A common adjustment device 32 adjusts the height adjustment of the return tube 14.

In under-pressure filling, the boiler gas-space 3.2 is subjected to an under-pressure, and the liquid valve 10 is opened by, for example, a pneumatic actuating device 22. In one practice, the boiler gas-space is subjected to an under-pressure of less than or equal to 1000 millibar.

Since the bottle 4 in the sealing position is located at the filler element 1, an under-pressure arises in the bottle 4 and in the filler element 1. In response, the filling contents flow along the inner surface of the wall into the bottle 4. This forces the return gas out of the interior of the bottle 4, through the return tube 14, and into the boiler gas-space 3.2. When the level of filling content in the bottle rises above the lower end of the return tube 14, filling ends automatically. Before the filled bottle 4 is lowered, the liquid valve 10 closes, and surplus filling content is suctioned out of the bottle 4, via the return tube 14, into the boiler 3. To adjust the filling height, one only has to axially adjust the return tube 14.

Ambient-pressure filling is carried out with the filler element 1 in a similar manner. In such a case, the liquid valve 10 opens when the bottle 4 presses against the filler element 1.

With minor design adaptations, different filling methods are possible with the filler element 1. In all these filling methods, the connecting channel 20 permanently connects the protection area 13.1 to the ring channel 19. In some embodiments, the ring channel 19 is pressureless.

Referring now to FIG. 4, for CIP cleaning of the filling system comprising the filler elements 1, a flushing bell 24 is located on each filler element. The flushing bell 24 forms a space that is closed off to the outside. The dispensing opening 8, the ring channel 15, and the return tube 14 all open into this space formed by the flushing bell 24.

For CIP cleaning, the return tube 14 moves in a downward direction H2 sufficiently far for the seal 18 to be located in the chamber 12, as shown in FIG. 4. The chamber 12 has an enlarged diameter that is greater than the outer diameter of the seal 18. As a result, connection is established between the chamber 12 and the extension 13. The boiler 3 is filled with the liquid medium for the CIP cleaning.

After the liquid valve 10 opens, either mechanically by the flushing bell 24 or by the actuation device 22, a fluid-level difference drives a flow of liquid CIP medium out of the boiler 3. This fluid-level difference exists between the boiler 3 and the ring channel 19 as well as between the boiler 3 and the upper end of the connecting channel 20 when the filling element is configured in the CIP connection.

In response, CIP medium flows out of the boiler 3 via the product line 7, and into the liquid channel 6. It continues through and eventually exits the liquid channel 6 via the dispensing opening 8. After doing to, it proceeds into the interior of the suction bell 24. Then, it leaves the suction bell 24 via the ring channel 15 and proceeds into the chamber 12 and the extension 13. Finally, it exits through the upper end of the extension 13 via the connecting channel 20, and into the ring channel 19 to be conducted away.

Figure 6:
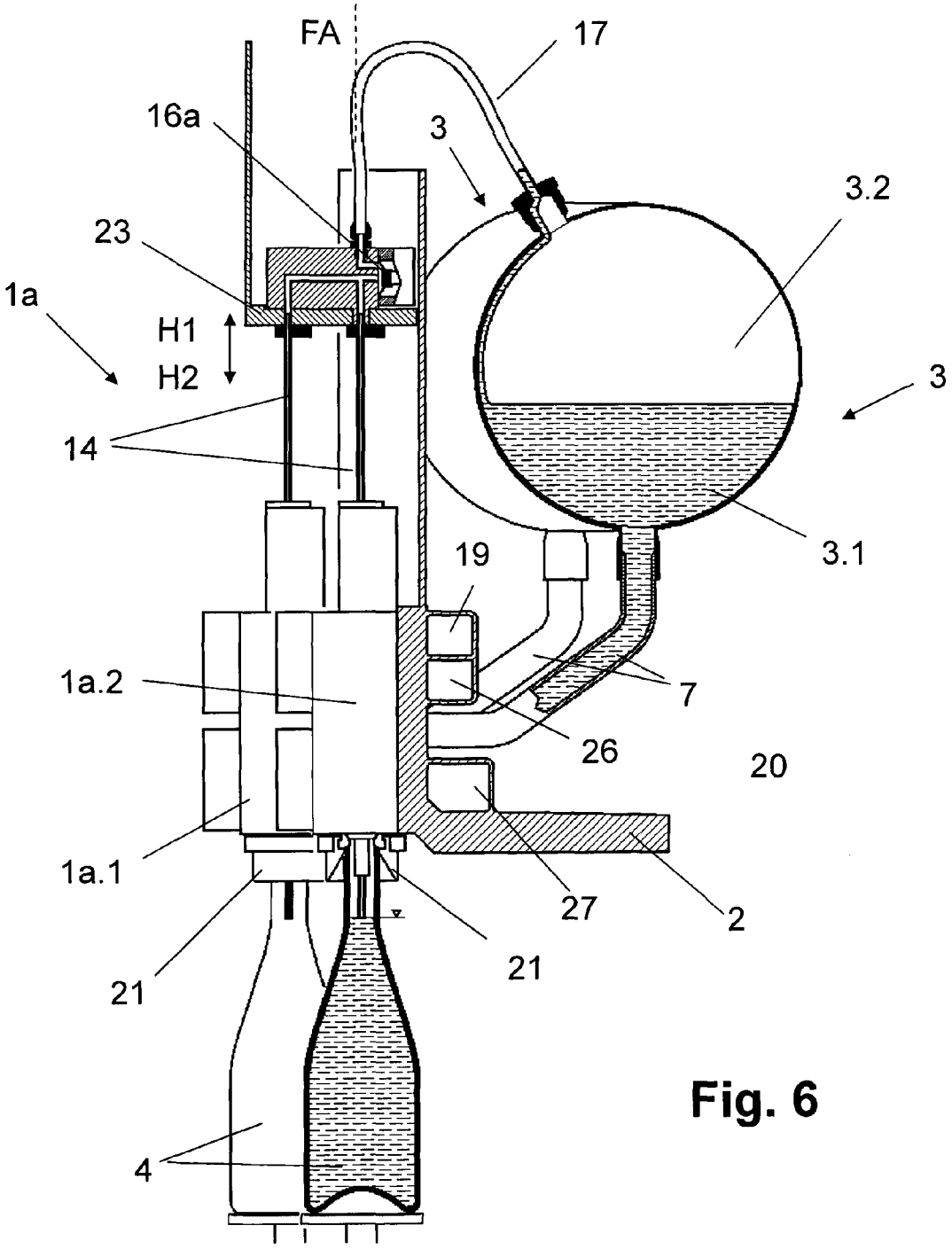
FIG. 6 shows a partially sectional view of a multiple filler element according to a further embodiment of the invention.

FIG. 6 shows an embodiment similar to that shown in FIG. 1 but with a multiple filler element 1*a* and two bottles 4. The illustrated embodiment shows the rotor 2, the boiler 3 provided at the rotor 2, and two bottles 4. The multiple filler element 1*a* has two individual filler elements 1*a*.1, 1*a*.2, each of which forms a filling point for filling a bottle 4.

As shown in FIG. 7, the individual filler elements 1*a*.1, 1*a*.2 have designs that correspond to the filler element 1, in particular, each individual filler element 1*a*.1, 1*a*.2 has a similar liquid channels 6, dispensing openings 8, liquid valves 10, and return tubes 14 that have adjustable heights, that serve as as return gas tubes and/or Trinox tubes, and that control the connection between the ring channel 19, which during CIP cleaning and/or CIP disinfection again serves as a CIP channel, and the respective chambers 12 by axial displacement of the return tubes 14 to the filler element 1.

As FIG. 7 also shows, unlike the filler element 1, the individual filler elements 1*a*.1, 1*a*.2 have control valves 25.1-25.4. Examples of control valves include pneumatically actuatable control valves. The control valves 25.1-25.4 are constituent parts of controlled gas or flow paths formed in the filler element housing 5. They provide a way to connect the chamber 12 and the ring channel 19 in a controlled manner and to connect additional ring channels 26, 27 at the rotor 2 provided in common for all the multiple filler elements 1*a*.1, 1*a*.2.

The functions of the individual filler elements 1*a*.1, 1*a*.2 correspond to that of the filler element 1. In particular, the multiple filler elements 1*a*.1, 1*a*.2 control opening of the connection between the chamber 20 and the ring channel 19, which, during the CIP cleaning and/or disinfection, acts as the CIP channel and conducts the CIP cleaning and/or disinfection medium.

The ring channel 26 is connected to the boiler gas-space 3.2 of the boiler 3. As a result, during filling, with the control valves 25.1, 25.3, 25.4 closed and the control valve 25.2 open the filling contents are forced out of the bottle 4 by the filling contents, and flow into the ring channel 26, or via the return tube 14, with the control valve 16*a* open, into the boiler gas-space 3.2.

The reference filling height in the respective bottle 4, over-filled at the end of the filling or of the filling phase, is adjusted, for example, in that, with the control valves 25.2-25.4 are closed, the control valve 25.1 is opened, to open the connection between the chamber 12 and the ring channel 19, which during the filling conducts a Trinox gas or inert gas under pressure, such as a CO2 gas or nitrogen under pressure, such that, with the control valve 16*a* open, the Trinox gas, introduced via the chamber 12 and the ring channel 15 into the head space of the sealing position at the respective individual filler element 1*a*.1, 1*a*.2, presses the surplus filling contents via the return tube 14, serving in each case as a Trinox tube, into the filling-contents boiler 3, for as long as required for the lower end of this return tube 14 to emerge out of the filling contents surface level, and so attaining the reference filling height. Before the bottle 4 is drawn away from the respective individual filler element 1*a*.1 or 1*a*.2 respectively, the control valves 25.1, 16*a* also close.

Each individual filler element 1*a*.1, 1*a*.2 can be in its own filler-element housing 1*a*.1, 1*a*.2. Alternatively, the two individual filler elements can be in a common filler-element housing.

A useful feature of the multiple filler element 1*a* is that a common travel or adjustment device 23 is provided for the return tubes 14 of each multiple filler element 1*a*. A further useful feature of the multiple filler element 1*a* is the fact that for both individual filler elements 1*a*.1, 1*a*.2 a common control valve 16 and a common flexible line 17 are provided. These connect the two return tubes 14 in a controlled manner by way of the control valve 16 with the boiler gas-space 3.2 of the filling-contents boiler.

Like the filler element 1, the multiple filler element 1*a* and the respective filling system can also be operated to carry out filling under atmospheric pressure. In this situation, during the filling, the gas that is forced by the filling contents out of the interior of the bottle arranged in the sealing position at the filler element, with the control valve 16 and 16*a* respectively open, is conducted back via the tube into the boiler gas-space 3.2 of the filling-contents boiler 3. The flow of the filling contents into the bottle is automatically ended by the immersion of the return tube 14 into the filling contents surface level and after the rise of the filling contents in the return tube 14. After the closure of the liquid valve and of the control valve 16 and 16*a* respectively, the filled bottle can be drawn away. The filling contents in the respective return tube 14 are retained there by the pipette effect, and then introduced into the next bottle to be filled by the opening of the control valve 16, 16*a*.

Figure 8:
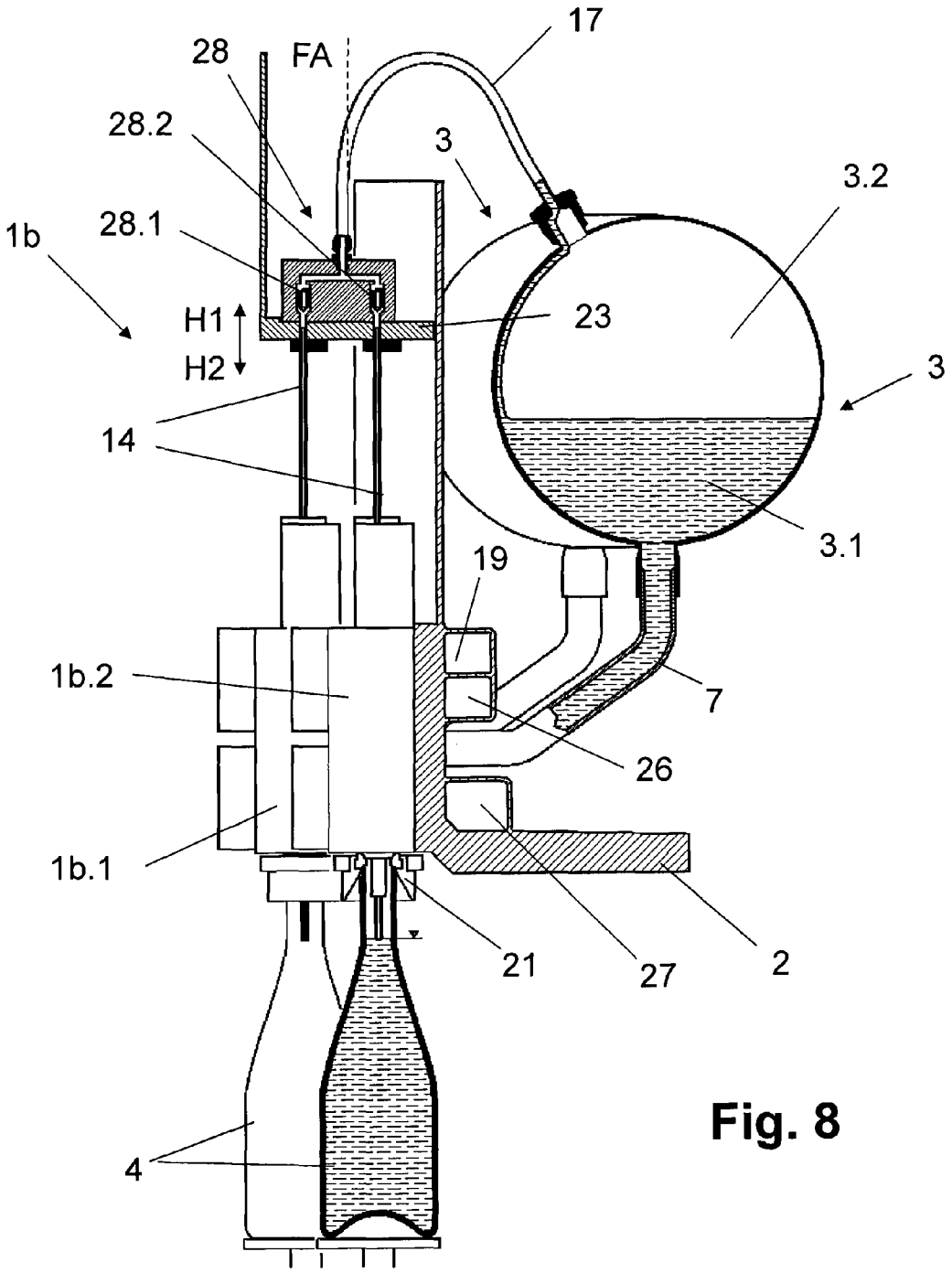
FIG. 8 shows a partially sectional view of a multiple filler element according to a further embodiment of the invention.

FIG. 8 shows a further embodiment in which a multiple filler element 1*b*, which in turn, as a double filler element, forms two individual filler elements 1*b*.1, 1*b*.2 that, in their structural design correspond to the individual filler elements 1*a*.1, 1*a*.2 respectively. The multiple filler element 1*b* differs from the multiple filler element 1*a* only in that, instead of the common control valve 16*a*, a non-return valve arrangement 28 is provided, with two non-return valves 28.1, 28.2, by means of which the return tubes 14 are in each case connected to the common flexible line 17. The non-return valves 28.1, 28.2 are basically designed in such a way that they open for a fluid flow out of the return tube 14 concerned into the flexible line 17 and close for a fluid flow in the opposite direction. In particular, the non-return valves 28.1, 28.2, in the embodiment shown, are designed in such a way that their valve bodies are subjected to slight weight and/or spring loading, such that, during filling, the non-return valves 28.1, 28.2 prevent a return gas flow out of the respective bottle 4 via the return tube 14, with the return gas instead flowing exclusively via the ring channel 15 and the control valve 25.2, which for example is open, into the ring channel 26. The filling of the bottle 4, arranged in the sealed position at the individual filler element 1*b*.1 or 1*b*.2 respectively, is automatically ended when the lower open end of the return gas channel 15 is immersed into the filling contents surface level. The adjustment of the reference filling height in the bottle 4, which is overfilled in each case, is effected by the Trinox or inert gas, under pressure, out of the ring channel 19, which is introduced by the opening of the control valve 25.1, via the ring channel 15, into the head space of the bottle 4 arranged in the sealing position at the individual filler element 1*b*.1 or 1*b*.2 respectively, and thereby surplus filling contents are forced out of this head space into the return tube 14, functioning as a Trinox tube, and via this into the filling-contents boiler 3. Thanks to the use of two non-return valves 28.1 and 28.2, independent working of both individual filler elements 1*b*.1 and 1*b*.2 is guaranteed, and in particular the situation is prevented that, when the reference filling height is being adjusted in one bottle 4, any filling contents are pressed via the return tube 14 into the other bottle 4.

The multiple filler elements 1*a*, 1*b*, and, respectively, the filling system comprising these multiple filler elements, have the additional advantage over the filler element 1 and, respectively, over a filling system comprising this filler element, that at least the number of control valves 16 required and of the electro-pneumatic valves which actuate these valves, the number of non-return valve arrangements 28, and the number of flexible lines 17 required for a predetermined number of filling locations can be reduced by 50%, which means, inter alia, that a substantial simplification can be achieved in terms of design and control technology, as well as a reduction in manufacturing and maintenance costs. The multiple filler element 1*b* has the further advantage in relation to the multiple filler element 1*a* that the control valve 16*a* is replaced by the non-return valve arrangement 28, and, as a result, the scale of the control technology required is reduced still further.

Common to the multiple filler elements 1*a* and 1*b* is the fact that the protection area 13.1 formed by the extension 13 above the seal 18 during the filling mode is separated from the chamber 12, but is in connection via the connecting channel 20 with the ring channel 19, i.e. is subjected to the inert gas under pressure of the ring channels 19, for example with the Trinox gas under pressure, and that, during the CIP cleaning, the connection between the chamber 12 and the extension 13 is fully opened solely by the common sinking of both return tubes 14 beyond the maximum adjustment travel distance H1.

A special consideration of the filler elements 1, 1*a*, 1*b* is that, in the CIP mode, the protection area 13.1 is continuously connected, via the connecting channel 20, with the ring channel 19, but is nevertheless separated by the seal 18 from the chamber 12. This advantage arises regardless of the particular filling method used.

As a result, during CIP mode the chambers 12, and therefore the areas to be treated by the CIP medium, namely the liquid channel 6 and the ring channel 15, are opened solely by the displacement of the seal 18 with the return tube 14 into the chamber 12 for the flowing of the CIP medium. The seal 18 thus forms the only control or switching valve arranged in the flow path of the CIP medium. The switching of other valves, whether pneumatically or electrically actuated, are in principle no longer required for switching between CIP mode and filling mode.

Having described the invention, and a preferred embodiment thereof, what is claimed as new and secured by Letters Patent is:

1. An apparatus for filling a container with liquid filling contents, said apparatus comprising a filler element that switches between a filling mode and a CIP mode, wherein said filler element comprises a filler element housing, a liquid channel, a dispensing opening, a liquid valve, a chamber, an extension, a filling-height-controlling element, a valve body, a first ring channel, a connecting channel, a seal, and a flush closure element, wherein said liquid channel is formed in said filler element housing, wherein said liquid channel is configured to be connectable to a filling-contents boiler, wherein said liquid valve is disposed in said liquid channel, wherein said liquid channel forms said dispensing opening, wherein said filling-height-controlling element controls filling height in said container, wherein, during filling of a container, a first end of said filling-height-controlling element projects beyond said dispensing opening and extends into said container, wherein axial movement of said filling-height-controlling element within an adjustable range adjusts said filling height, wherein, in CIP mode, liquid CIP medium is conducted out of said boiler, flows through said filler element, and out of said filler element into said first ring channel, wherein, in CIP mode, said flush closure element closes said filler element at said dispensing opening, wherein said chamber is formed in said filler element housing, wherein said extension connects to said chamber on an upper side of said filler element housing facing away from said dispensing opening, wherein said filling-height-controlling element is guided through said extension, wherein said connecting channel connects said extension to said first ring channel, wherein, in CIP mode, said liquid CIP medium flows through said liquid channel, said chamber, and said extension, wherein said seal blocks a fluid connection between said chamber and said first ring channel when said filling element is in filling mode, wherein said seal clears said fluid connection between said first ring channel and said chamber when said filling element is in CIP mode, wherein said seal is provided on said filling-height-controlling element and moves with said filling-height-controlling element, wherein, during said filling mode, said seal blocks said fluid connection between said chamber and said connecting channel of said extension, wherein, during CIP mode, said seal opens said fluid connection between said chamber and said connecting channel of said extension, wherein opening and closing of said seal is controlled by axial movement of said filling-height-controlling element, and wherein, in said filling mode and in said CIP mode, a continuous fluid connection exists through said connecting channel between said extension and said first ring channel.

2. The apparatus of claim 1, wherein said seal blocks the entirety of said fluid connection.

3. The apparatus of claim 1, wherein said extension comprises a cylinder, wherein said seal defines a piston that moves within said cylinder in response to axial movement of said filling-height-controlling element, and wherein said piston selectively blocks said fluid connection between said chamber and said connecting channel.

4. The apparatus of claim 3, wherein said seal is configured to open said fluid connection between said chamber and said connecting channel by moving out of said extension and into a volume that has a cross-section that is larger than said seal.

5. The apparatus of claim 3, wherein said chamber has a cross-section that is larger than said seal, and wherein said seal is configured to open said fluid connection between said chamber and said connecting channel by moving out of said extension and into said chamber.

6. The apparatus of claim 1, further comprising a valve tappet for said liquid valve and a second ring channel, said second ring channel being disposed between said valve tappet and said filling-level controlling element, wherein said valve tappet comprises a pipe that is coaxial with a filler element axis, wherein said filling-height-controlling element is guided through said pipe, wherein said second ring channel is open on an underside of said filler element, and wherein said second ring channel opens into said chamber.

7. The apparatus of claim 6, wherein said flush closure is configured to selectively direct said liquid CIP medium to run out of said filling-contents boiler, via said liquid channel, via said opened liquid valve, via an interior of said flush closure element, via said second ring channel, via said chamber, through an opening formed from said chamber into said extension as a result of movement of said seal into said chamber, and via said extension, which is connected to the said first ring channel.

8. The apparatus of claim 1, wherein said connecting channel of said extension is formed from a connecting channel in said filler element housing, and wherein said connecting channel is connected to said ring channel.

9. The apparatus of claim 1, wherein said filling-height-controlling element comprises a return gas tube.

10. The apparatus of claim 1, wherein said filling-height-controlling element comprises a Trinox tube.

11. The apparatus of claim 1, wherein said filler element is configured for filling said container at under-pressure.

12. The apparatus of claim 1, wherein said filler element is configured for filling said container at ambient pressure.

13. The apparatus of claim 1, wherein said filler element is a multiple-filler element comprising a plurality of individual filler elements.

14. The apparatus of claim 13, wherein said filling-height-controlling element comprises a plurality of return gas tubes, and wherein said apparatus further comprises a common adjustment device for adjusting filling heights of said individual filler elements of said multiple filler element.

15. The apparatus of claim 1, wherein said filling-height-controlling element comprises a plurality of return gas tubes, said apparatus further comprising a common control valve to connect said return gas tubes to a filling-contents boiler.

16. The apparatus of claim 1, wherein said filling-height-controlling element comprises a plurality of return gas tubes, and wherein said apparatus further comprises a non-return valve arrangement to connect said return gas tubes to a filling-contents boiler.

17. The apparatus of claim 16, wherein said non-return valve arrangement comprises at least one non-return valve for each return gas tube.

18. The apparatus of claim 16, wherein said non-return valve arrangement opens into the said chamber, wherein said non-return valve arrangement at least one of blocks or constricts a flow in and out of said chamber.

19. The apparatus of claim 16, wherein at least one non-return valve of said non-return valve arrangement first opens at a pressure that exceeds a filling pressure.

20. The apparatus of claim 1, further comprising a rotor, wherein said filler element is one of a plurality of identical filler elements disposed on a periphery of said rotor.

* * * * *